United States Patent [19]

Leitner et al.

[11] Patent Number: 4,484,789

[45] Date of Patent: Nov. 27, 1984

[54] MERCURY SLIP RINGS AND METHOD

[75] Inventors: Frank W. Leitner, Greenville, S.C.; James B. Bamberg, Charlotte, N.C.

[73] Assignee: Motek Laboratories Ltd., Greenville, S.C.

[21] Appl. No.: 149,923

[22] Filed: May 14, 1980

[51] Int. Cl.[3] ..... H01R 39/30

[52] U.S. Cl. ..... 339/5 L; 339/8 L

[58] Field of Search ..... 339/5 L, 8 L

[56] References Cited

U.S. PATENT DOCUMENTS 3,127,230 3/1964 Marquis et al. ..... 339/8 L X 3,431,532 3/1969 Cary ..... 339/8 L

FOREIGN PATENT DOCUMENTS 1259994 2/1968 Fed. Rep. of Germany ..... 339/8 L

*Primary Examiner*—Eugene F. Desmond

[57] ABSTRACT

The invention comprises apparatus and a method for establishing electrical connections between stationary and rotating circuitry means of a device via a fluid mercury medium which avoids all previous dangers associated with the use of mercury and mercury vapors, and realizes constant low resistance, reliable, and long lived connections. Liquid mercury is enclosed within a cavity and/or capsule within the device during shipping and storage, and only liberated upon intentional release when activating the device. Sealing of the device against fluid escape employs the use of minimal possible escape paths, machined surfaces and pressure forcing contacting surfaces together. These possible escape paths include a material which will decontaminate the mercury by amalgamation upon contact. A further cavity or capsule in the device contains sufficient decontamination material as to render all of the mercury harmless and is intentionally released prior to disassembly or repair of the device. These many features insure environmental protection.

19 Claims, 5 Drawing Figures

MERCURY SLIP RINGS AND METHOD

BACKGROUND OF THE INVENTION

1. Field of the Invention

The invention achieves the safe use of mercury for electrical current conduction between stationary and rotating parts of an input-output structure or device prior to and during shipping of the structure, during operation, and for disassembly and repair of the structure by preventing environmental contamination of all stages.

2. Prior Literature

No literature is known which discloses the safe use of mercury slip rings but rather industry has avoided its use, because of environmental pollution, and substituted therefor coaxial air coupled cores and the like for electrical energy transfer with rotating machinery.

SUMMARY OF THE INVENTION

The invention supervises mercury confinement in its application as a slip ring type connection between rotating and stationary device components in three stages of existence. First, the mercury is confined in a closed cavity and/or capsule to permit shipping or non-use of the components, and is only intentionally liberated within the device when use is imminent. Secondly, the liberated mercury is confined to the components by employing one or more of: minimal escape paths, machined or ground contacting surfaces, pressure exerted to close the surfaces, and the use of decontaminating material in the possible escape paths. Thirdly, a separate contained supply of the decontaminant material is stored within the device, and is releasable prior to disassembly for repair or the like to neutralize the mercury so it does not harm the repairman or pollute the atmosphere.

DESCRIPTION OF A PREFERRED EMBODIMENT

Figure 1:
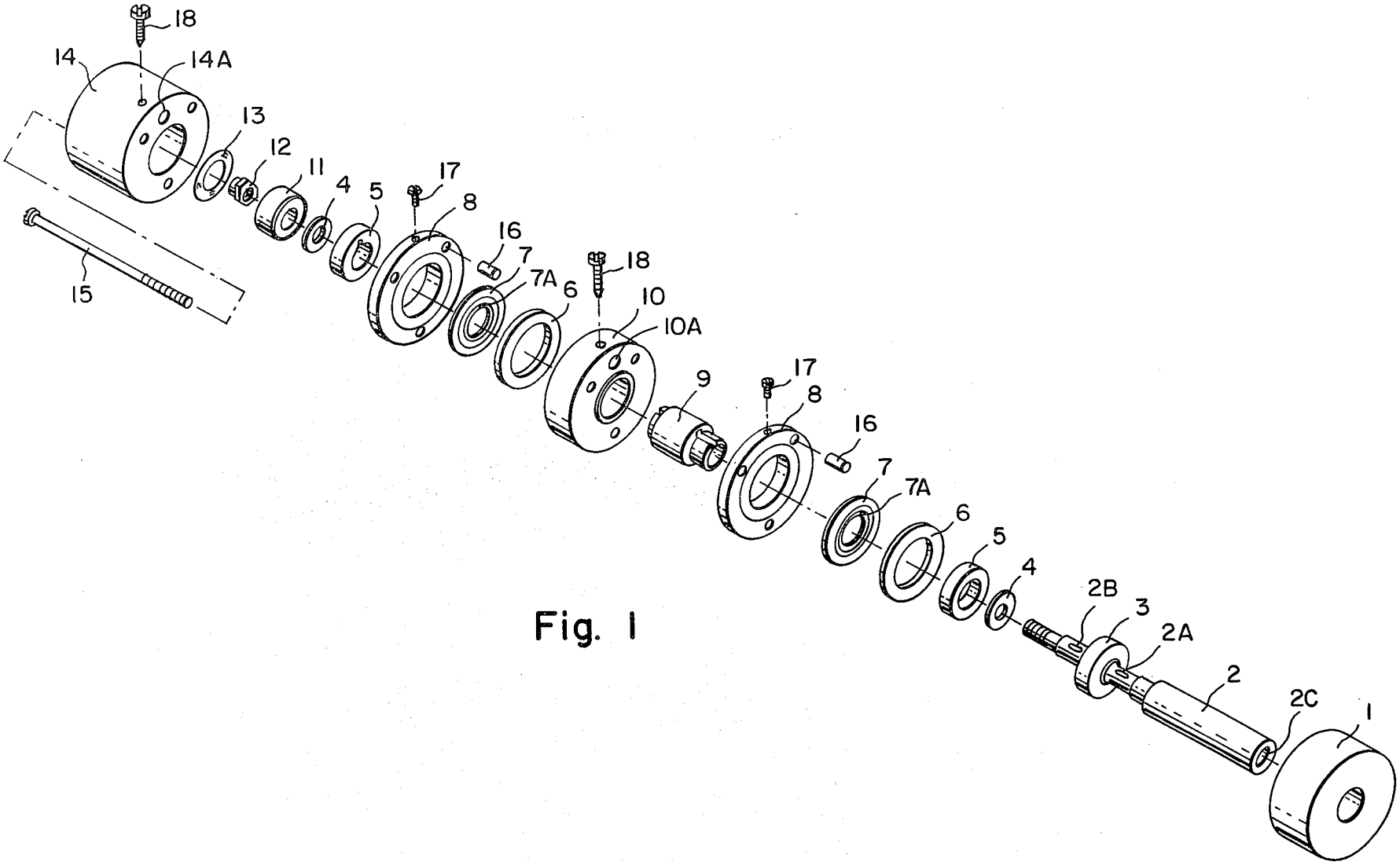
FIG. 1 is an exploded view of the preferred mercury slip ring structure.

This invention relates to the design and construction of fluid containing means (mercury slip rings) which are used to carry electricity between fixed and rotating parts of electrical machinery.

A primary purpose of the invention is to provide a means for sealing the input-output circuitry assembly so as to preclude air polution which results from vaporization of (eg) the mercury into the atmosphere as well as consequential loss of liquid mercury which could render the unit inoperative.

A further purpose is to provide a means—prior to use of the device—for encapsulating the fluid medium (mercury) within the assembly, but outside the fluid connection (slip rings) proper, to provide for easy assembly during manufacture, as well as for safe storage and shipping.

Another purpose is to provide means for the safe decontamination of the mercury within the assembly by combining or amalgamating the mercury with some substance, usually in granular form, to render the mercury harmless to personnel who may dismantle the unit for overhaul or salvage. Such substance may comprise fine silver particles, sulphur or other known materials.

The mercury slip ring assembly consists of a hollow shaft 2 to which are fixed bearings 3 and 11, inner slip rings 7 with their electric wires 7B, soldered into holes 7A, said electric wires entering the shaft 2 through holes 2A, 2B and exiting through coaxial hole 2C. Holes 2A, 2B are made in the form of slots to facilitate the task of assembly during manufacture. Also fixed to shaft 2 are the shaft insulator 9 and shaft insulator sleeves 5 which electrically insulate the shaft 2 from the inner slip rings 7 and the inner slip rings 7 from each other, and essential assembly hardware—the insulation support washers 4 and assembly nut 12.

In the usual case, the shaft 2 with above parts assembled thereto, rotates, and the remaining parts of the assembly are stationary. Of course, in some applications, it might be desirable to have the shaft 2 and assembled parts fixed (non-rotating) and the remaining parts rotating.

Figure 2:
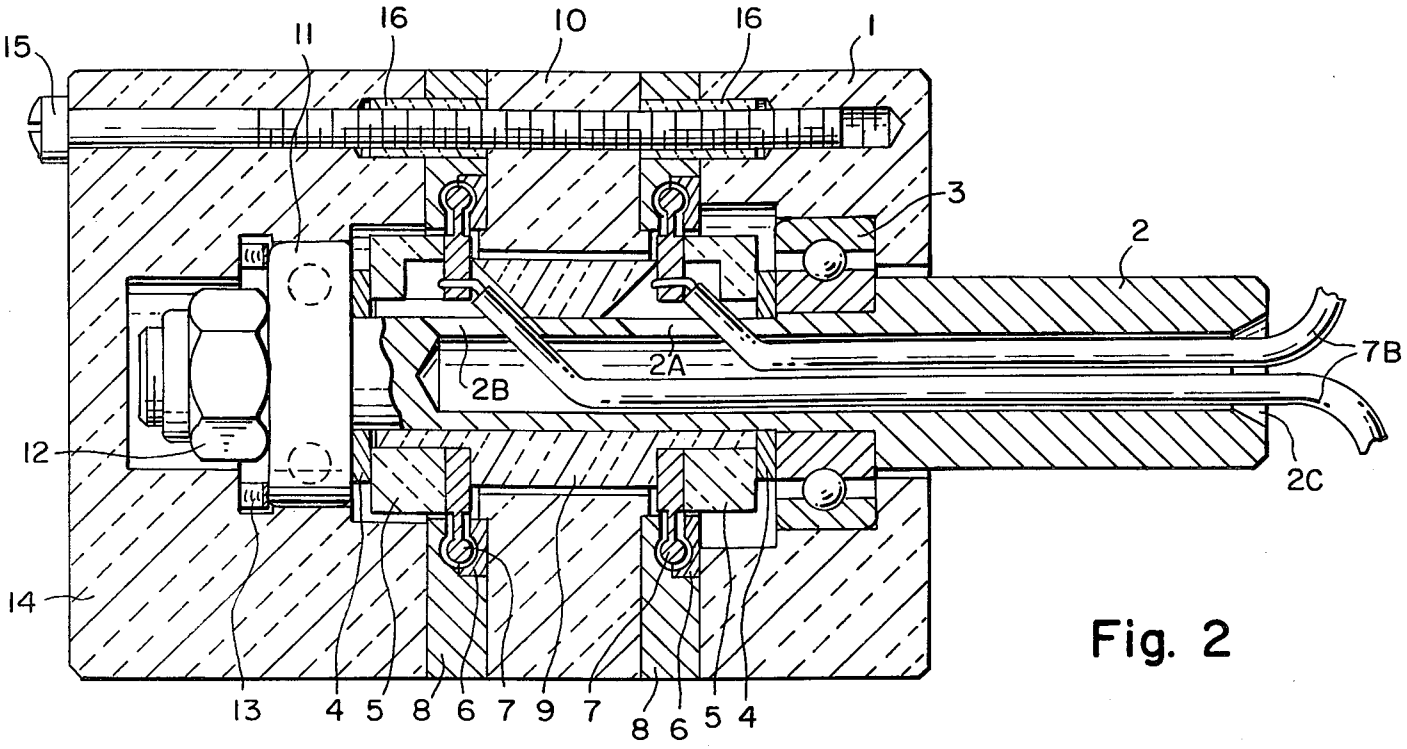
FIG. 2 shows the assembly in cross section.

The usually stationary parts in the instant design include the front housing 1, the center housing 10, and the rear housing 14, between which are assembled the outer slip rings 8 and their slip ring closures 6. These stationary parts are held together by assembly screws 15 (Only one shown). The outer slip rings 8 are electrically insulated from the assembly screws 15 and from each other by the outer slip ring insulators 16, three of which are required for each outer slip ring 8, although only one for each is shown in FIGS. 1 and 2. The front housing 1, center housing 10, and rear housing 14 are all made of phenolic or other suitable insulation material, in the instant design, thereby insulating outer slip rings 8 from each other and from bearings 3, 11.

Electrical connections to the outer slip rings 8 are made by electric wires or straps—"pigtails"—(not shown) attached by connection screws 17, (FIG. 1).

Although the described and pictured design includes two sets of slip rings providing for two electrical connections, any number may be used as the application requires.

Figure 3:
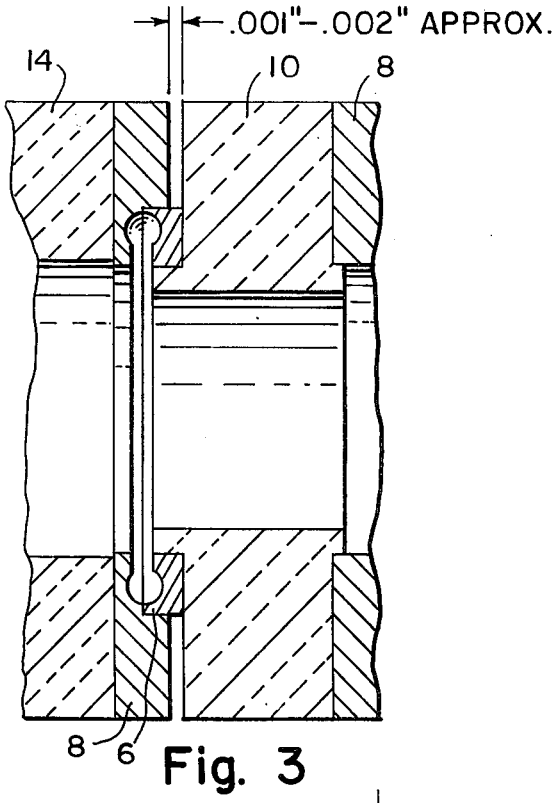
FIG. 3 is an enlarged view showing the slip ring closure sealing the outer slip ring; and, FIGS. 4 and 5 show details of the charging and capsule puncturing and sealing arrangement.

The following features contribute to making the mercury slip ring assembly effectively sealed and polution-free:

1. There is a close fit between the front bearing 3 and the front housing 1 to preclude vapor escape along the housing bore.
2. This close fit is enhanced by the wave washer 13 which serves as a thrust spring, pressing the front bearing 3 into its seat in the front housing 1.
3. The front bearing 3 contains double seals, typical of ball bearings.
4. The interference fit between the outer slip rings 8 and slip ring closures 6, as shown in FIG. 3, effectively prevents mercury leakage between these two parts. Tight assembly screws 15 maintain a close and tight contact between center housing 10 and slip ring closure 6; in turn maintaining a close and tight contact between slip ring closure 6 and outer slip ring 8. The same conditions apply, of course, to front housing 1 and its adjacent slip ring closure 6 and outer slip ring 8.
5. Fine machine surface finishes on the faces of the outer slip rings 8, slip ring closures 7 and housings 1, 10, 14 effectively obviates the necessity for gasketing these interfaces although gaskets such as "O" rings could be used if desired or necessary.

6. The closed end construction of the rear housing 14 eliminates an obvious potential area of leakage. Commercial manufacturing tolerances as well as heat expansion coefficients requires a thrust spring of some type. In the event it is desired to construct a mercury slip ring assembly which uses a through-shaft, the wave washer 13 could be replaced by an "O" ring which could provide both the thrust and sealing properties required.

Additionally, it was found helpful to provide minimal clearances between the shaft insulator 9 and center housing 10, and between the shaft insulator sleeves 5 and the outer slip ring 8 or slip ring closure 6. These small clearances proved effective in keeping the mercury, at least while in the liquid state, within the slip ring wells. The shaft insulator 9 and the shaft insulator sleeves 5 have slots 2A and 2B which provide for passage of the electrical wires from the inner slip rings 7 into and through the shaft 2. These slots do not extend to the outer diameters of said parts, and therefore there is no access for the mercury to the shaft 2.

A mercury charging port is drilled radially from the outside circumference of each outer slip ring 8 (FIGS. 1 and 4) into the mercury well 10A. After charging with a pre-measured quantity of mercury, the charging ports are closed with screws 18 similar to connection screws 17.

Figure 4:
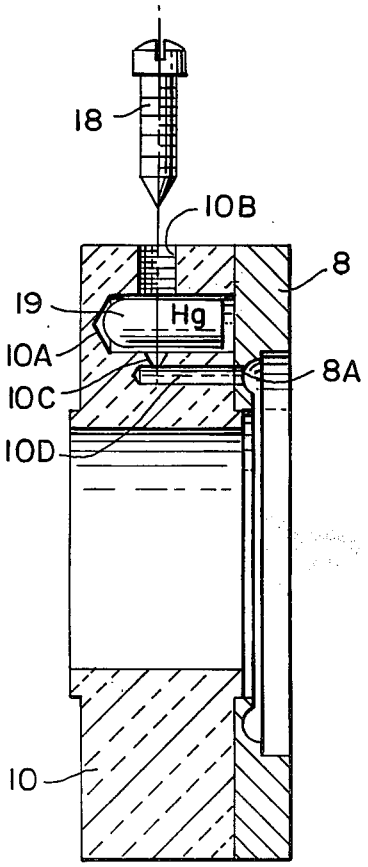
Figure 5:
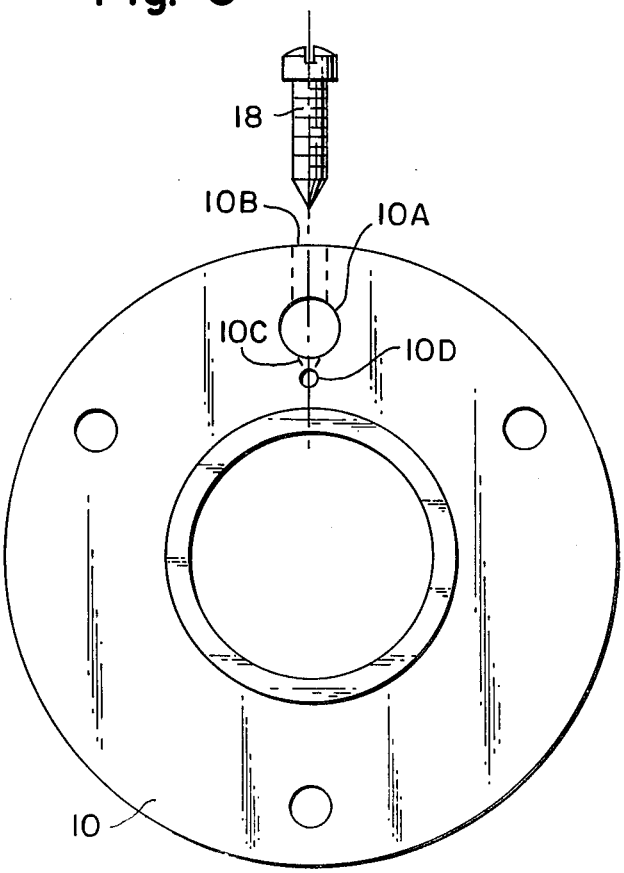

Turning now to the secondary and tertiary purposes: FIGS. 4 and 5 show a means to provide for encapsulating the mercury within center housing 10 with further, a means to release at will, the mercury from the capsule 19 thereby allowing it to flow into the slip ring well when it is desired to place the mercury slip ring assembly into service.

Center housing 10 and rear housing 14 may be provided with cavities 10A and 14A, (FIG. 1), respectively. Intersecting these cavities are screw threads and conical valve seats 10B, (FIG. 4) and 10C, with corresponding parts for rear housing 14, not illustrated. As will be explained, these screw threads and valve seats are optionally fitted with conically pointed capsule puncturing and cavity sealing screws 18. The valve seats lead to ports, such as 10D, (FIG. 4), which engage ports 8A drilled into the outer slip rings 8.

Should it be desired, front housing 1 may be constructed similarly to the center housing 10 and rear housing 14 in regard to the cavity, valve seat and port, provided the relative dimensions of the parts permit.

At the time of assembly, a soft, pliable, plastic capsule 19, (FIG. 4), containing the required quantity of mercury is placed within the cavities such as 10A. It is important that these capsules 19 contain some air or other suitable gas (es).

When it is desired to place the mercury slip ring assembly into service, the capsule puncturing and cavity sealing screws 18 are driven into the housings 10, 14. The sharp points of the screws 18 penetrate the upper surface of the capsules 19. Because the capsules 19 containing some air as mentioned supra, the capsules 19 are permitted to deform under the pressure of the screws 18, and therefore no mercury is expelled around the points of the screws 18 when the capsules 19 are punctured.

The screws 18 are driven further until they also puncture the lower portion of the capsule 19. Then the screws 18 are partially withdrawn, allowing the mercury to flow through the ports 10D, 8A into the wells of the outer slip rings 8.

After allowing sufficient time for all the mercury to flow into the wells of the outer slip rings 8, the screws 18 are fully driven into the housings 10, 14 until the conical points of the screws 18 fully engage the conical valve seats, such as, 10C, thereby sealing the mercury within the slip ring assembly. Of course, the screws 18 must be positioned uppermost during this operation, in order that gravity may do its work and cause the mercury to flow downward into the wells of the outer slip rings 8.

It can be readily seen that because of the relative sizes of the housings 10, 14 and their cavities 10A, 14A, several cavities can be provided within each housing 10, 14. If desired, a second cavity 10A, 14A with valve seats 10C, 14C and ports 10D, 14D can be made within each housing 10, 14. These would engage additional valve seats 10C, etc. which are provided with conically pointed screws similar to or identical to the capsule puncturing and cavity sealing screws 18.

The above mentioned additional features may provide means to accomplish the tertiary purpose, because conventional mercury vapor assemblies cannot be safely repaired; and if opened, toxic mercury vapor escapes into the atmosphere. The present invention includes a detoxification material cavity or capsule receiving region for communication with the sealed mercury vapor region to decontaminate the mercury vapor upon intentional release of the detoxifying material into said communication.

This chemical material will neutralize the mercury, to prevent vapor escape, and may comprise zinc or sulphur powder, as well as other well known materials suited to this purpose (ie) which will amalgamate with mercury.

During assembly, the secondary cavity may be provided with a sealing screw 18 which is fully driven so as to close off the cavity, such as 10A, from the slip ring well. Some substance, granular iron as an example, which would combine or amalgamate with the mercury is placed within the cavity. If and when it is desired to render the mercury harmless, the secondary cavity sealing screw 18 is withdrawn a few turns from its valve seat. The mercury slip ring assembly is positioned so that the sealing screw and cavity are downward. Mercury then flows into the cavity where it combines with the amalgamating substance, thereby rendering the mercury harmless.

A variation on the above is to provide the secondary cavity containing the amalgamating substance with no valve seat 10C, 14C or sealing screw 18, but instead provide a port 10D, 14D significantly smaller than the granular substance. In this case, the amalgamating substance combines with any mercury vapor present, thereby rendering it harmless.

Of course, mercury slip ring assemblies can be constructed with any or all of the abovedescribed features for mercury charging and mercury removal and/or amalgamating.

The amalgamating material is located at the outer edges of any possible escape routes for the mercury such that it is decontaminated only if it is likely to reach the environment. Such locations are between the housing members 10 and 14 of FIG. 3, toward the outer periphery thereof; along the right hand edges of bearing 3, along both edges of outer slip rings 8, past bearing 11, and along assembly screws 15.

What is claimed is:

1. An input-output device for rotating circuitry, comprising in combination a body;

a fluid electrically conductive medium within said body;

rotating means at least partly within said medium;

said body comprising stationary body means in contact with said medium for external connection;

said medium electrically connecting said rotating means to said stationary means;

a plurality of different means for sealing said medium in liquid and in vapor state against release to the environment;

means within the body for confining said medium and means accessible from outside of the body for releasing said medium into said contact with the rotating means and stationary body means; and, said releasing being accomplished at a point in time only immediately prior to placing said device into utilization.

2. The device of claim 1 wherein;

said means for sealing comprises;

material distributed along any potential egress which will amalgamate with said fluid; and at least one of:

O-ring seals; wave washers; and pressure seals.

3. The device of claim 1 wherein said releasing is irreversible and only done once.

4. The device of claim 3 wherein the means for releasing comprises;

mechanical means movable into a first position for releasing the confined medium into the sealed region via a port of entry.

5. The device of claim 4 wherein;

said mechanical means in a second position being operable to seal said port of entry for said medium.

6. The device of claim 5 wherein;

said medium is contained within the sealed region in at least partly liquid state; and said mechanical means pierces the confining means to release vapor from said liquid state and to release the liquid.

7. The device of claim 6 wherein;

said medium is mercury.

8. The device of claim 7 comprising;

compression means for effecting said sealing.

9. The device of claim 8 wherein;

said mercury is contained within a rupturable capsule.

10. The device of claim 9 wherein;

said capsule further contains gas.

11. The device of claim 10 further comprising;

coatings of a material applied to any possible escape paths from said sealed region;

said mercury, upon release, combining with the coated material of the sealed region to render it harmless.

12. The device of claim 11, further comprising;

separate container means for a material adapted for communication with said sealed region to neutralize said mercury upon intentional actuation of said communication.

13. The device of claim 12 wherein;

said container means material comprises zinc powder, or sulphur powder, or other material readily combinable with mercury.

14. The method of protecting the environment from mercury contamination when mercury to be utilized as slip ring electrical connections between stationary and rotating components of a device, comprising the steps of:

containing the mercury within the device for release when the device is ready to be used;

enclosing a space encompassing a portion of the stationary and rotating components;

releasing the mercury into said space for utilization;

containing a material suitable for decontaminating said mercury; and, releasing said material into said space prior to disassembly of said device.

15. The method of claim 14 wherein said enclosing comprises;

coating every possible escape path from said space with decontaminating material.

16. The method of claim 15 wherein said enclosing further comprises;

machining or grinding the contacting faces of abutting parts forming said enclosed space; and, applying compressing force to said parts to seal the contacting faces.

17. The method of claim 16 wherein;

said compressing force is supplied by a wave washer which also seals.

18. Apparatus for applying electrical energy across a gap, comprising in combination;

a body member having body slip rings;

a rotatable member having rotatable slip rings for location adjacent the body slip rings to leave said gap;

fluid mercury contained in a cavity in said body for disposition in said gap;

multiple means including compression means for sealing the region around said gap;

said cavity adapted for communication with said region;

means for establishing said communication only once a further cavity containing a material capable of decontaminating the mercury adapted for communication with said region; and means for establishing said last mentioned communication prior to disassembly of the members.

19. The apparatus of claim 18 wherein;

the sealing means comprise a coating of decontaminating material in each possible escape path between said region and the atmosphere.

* * * * *